United States Patent [19]

Suska

[11] Patent Number: 4,686,743

[45] Date of Patent: Aug. 18, 1987

[54] HINGE INCORPORATING LEAF PADS AND TABS OF UNIFORM THICKNESS

[76] Inventor: Charles R. Suska, R.R. 1, Box 14, Roxbury, Conn. 06783

[21] Appl. No.: 880,340

[22] Filed: Jun. 25, 1986

Related U.S. Application Data

[63] Continuation of Ser. No. 687,733, Dec. 31, 1984, abandoned.

[51] Int. Cl.[4] ..... E05D 5/06

[52] U.S. Cl. ..... 16/389; 16/387

[58] Field of Search ..... 16/386, 389, 390

[56] References Cited

U.S. PATENT DOCUMENTS

| | | | |
|---|---|---|---|
| 106,170 | 8/1870 | Jones | 16/390 |
| 290,398 | 12/1883 | Clarkson | 16/386 X |
| 755,211 | 3/1904 | Boring et al. . | |
| 781,905 | 2/1905 | Pfleghar . | |
| 1,537,867 | 5/1925 | Mossbacher | 16/389 |
| 1,872,077 | 8/1932 | Forbes . | |
| 1,954,934 | 4/1934 | Houdaille et al. | 16/386 X |
| 2,158,548 | 5/1939 | Lemire et al. | 16/304 X |
| 3,506,326 | 4/1970 | Tantillo | 16/389 X |
| 3,566,539 | 3/1971 | Ridgley . | |
| 4,385,418 | 5/1983 | Loftis et al. . | |

*Primary Examiner*—Fred Silverberg

*Attorney, Agent, or Firm*—Brumbaugh, Graves, Donohue & Raymond

[57] ABSTRACT

A light duty hinge is formed by a pair of hinge leaves from which include interfitting tabs, the leaf pads and tabs being of uniform thickness. Holes provided in the tabs afford, when the tabs are interfitted, axially aligned openings for receiving the hinge pin.

8 Claims, 7 Drawing Figures

HINGE INCORPORATING LEAF PADS AND TABS OF UNIFORM THICKNESS

This application is a continuation of application Ser. No. 687,733 filed on Dec. 31, 1984 now abandoned.

BACKGROUND OF THE INVENTION

Conventional hinges ordinarily comprise leaves including a barrel. The barrel of a conventional hinge comprises two or more knuckles of leaf material rolled into circular loops, the interiors of which, when aligned, constitute a bore to receive a hinge pin.

Known quality hinges provide advantages of strength and durability but at a significant cost in material and manufacturing operations. When doors or other members to be hinged are light and used moderately, hinge strength and durability are of secondary importance.

Various forms of hinges for special application do not use the well-known rolled knuckle. For example, U.S. Pat. No. 4,385,418 describes a special purpose hinged flap for use in a jet aircraft cooling system. To insure security and reliable operation, the hinge components are formed of relatively thick metal. The lug type knuckles are stepped down from each leaf, thus providing leaves thicker than the knuckles by an amount corresponding to the elongation of a hinge pin head to accommodate a slot.

BRIEF SUMMARY OF THE INVENTION

The present invention provides improved, inexpensive hinges, each of which is formed by a pair of hinge leaves which include interfitting tabs. The leaf pads and tabs are cut, stamped or otherwise configured from a material of uniform thickness. Holes provided in the tabs afford, when the tabs are interfitted, axially aligned openings for receiving a hinge pin for the leaves.

The tabs are formed with the leaf pads, but instead of encircling the hinge axis at a distance therefrom depending on the hinge pin diameter, the tabs are directly oriented toward the hinge axis with the thickness of each tab fully encasing the small diameter pin. Thus, the inventive hinges, which normally include at least two thrust bearings and at least three shear planes for the hinge pin, are useful in supporting lightweight doors and the like in spite of their use of lesser amounts of material.

These and other features and advantages of the invention will be more readily understood when the following description is read in connection with the accompanying drawings.

DESCRIPTION OF EXEMPLARY EMBODIMENTS

Figure 1:
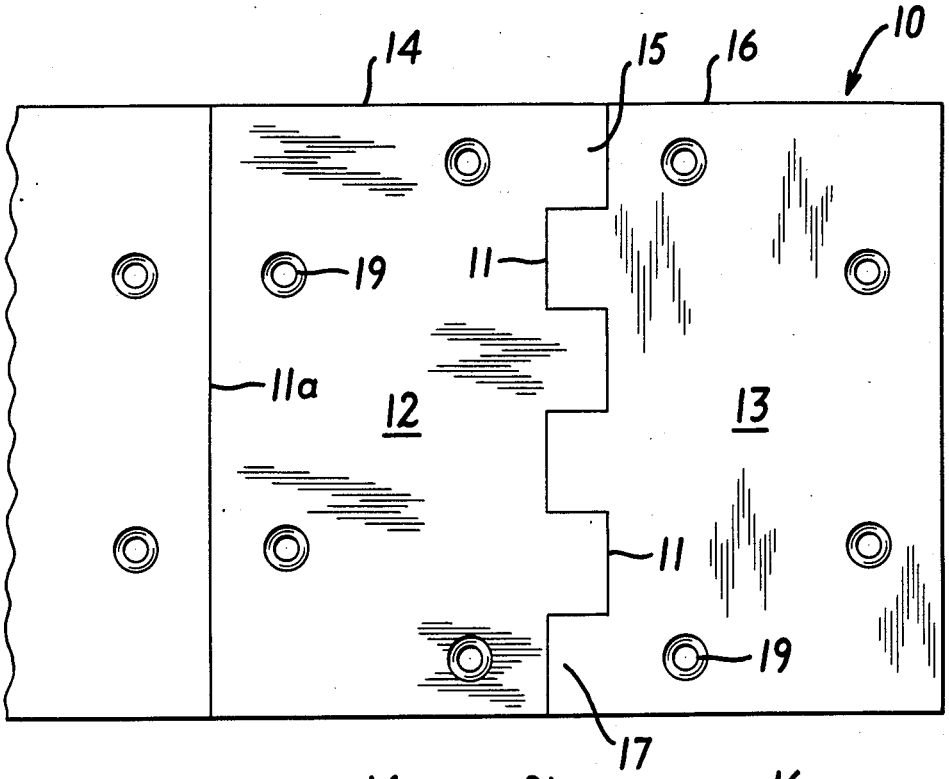
FIG. 1 is a view of a strip from which a hinge is made in accordance with the invention.
Figure 2:
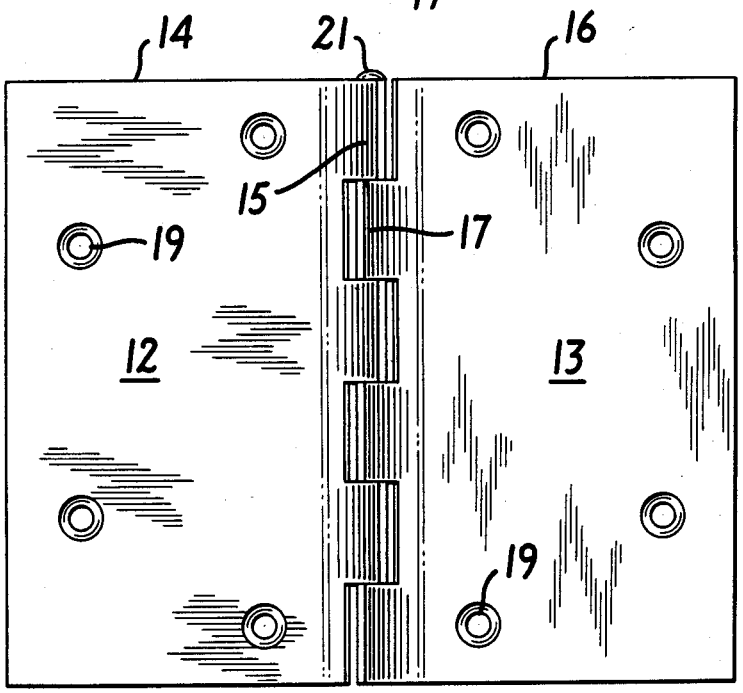
FIG. 2 is a side view of the hinge formed in accordance with the present invention from the strip of FIG. 1.

Referring to the drawings with particular reference to FIG. 1, a strip 10 of sheet metal from a roll (not shown) is separated along lines 11 and **11*a* to provide two identical hinge blanks 12 and 13, respectively, formed of leaf mounting pad 14 and tabs 15 and leaf pad 16 and tabs 17**. Separation and sizing may be cutting, stamping or like processes to suitably blank the leaves from the strip of sheet metal and provide desired clearance between the interfitting tabs. Note that the manufacturing procedures described are exemplary and other processes can be used to provide a double-leaf blank from strip or sheet stock.

Figure 3:
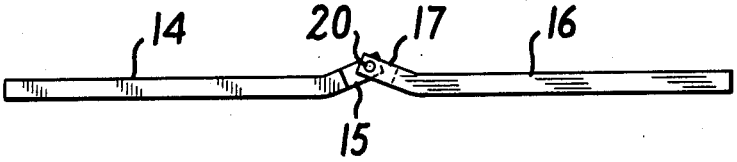
FIG. 3 is an end view of the hinge shown in FIG. 2.
Figure 4:
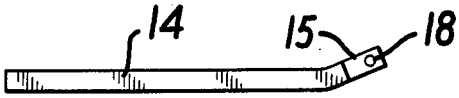
FIG. 4 is an end view of one of the hinge leaves of FIGS. 2 and 3.

After blanking the leaves out of the strip, or out of sheet material, the interfitting tabs 15 and 17 are angularly disposed to the leaf pads, as best shown in FIG. 3, to provide a desired type hinge. With certain hinge types, only the tabs on one leaf will be angularly deposed to the leaf pad by bending the tabs or in any other desired manner. The tabs are also drilled to provide holes 18 (FIG. 4) in the interfitting tabs 15 and 17. The openings are axially aligned when the leaves 14 and 16 are juxtaposed, as shown in FIG. 3, to facilitate insertion of a hinge pin 20 provided with a head 21. Countersunk screw holes 19 are formed at a station in the progressive tools just before the strip is advanced to the station that blanks out the leaves.

Preferably the hinge pin head 21 is of a diameter about the same as the thickness of the tabs 15 and 17. If desired, the head 21 may be omitted and the pin retained in position by tightly fitting into one of the tabs 15 and 17, for example the lower tab 17. This can be accomplished by knurling one end of the pin 20 or by forming a slightly smaller hole through one of the tabs.

In assessing the advantageous savings in materials and manufacturing operations provided by the invention, note that with a conventional knuckle, a separate rolling step is involved. Also, the prong used to form the knuckle is normally 3.1416 times the mean diameter of the rolled knuckle, plus about one-eighth inch clearance. Contrasting such prong with the short tab 15 evidences the significant decrease in material usage with the inventive hinges.

Figure 5:
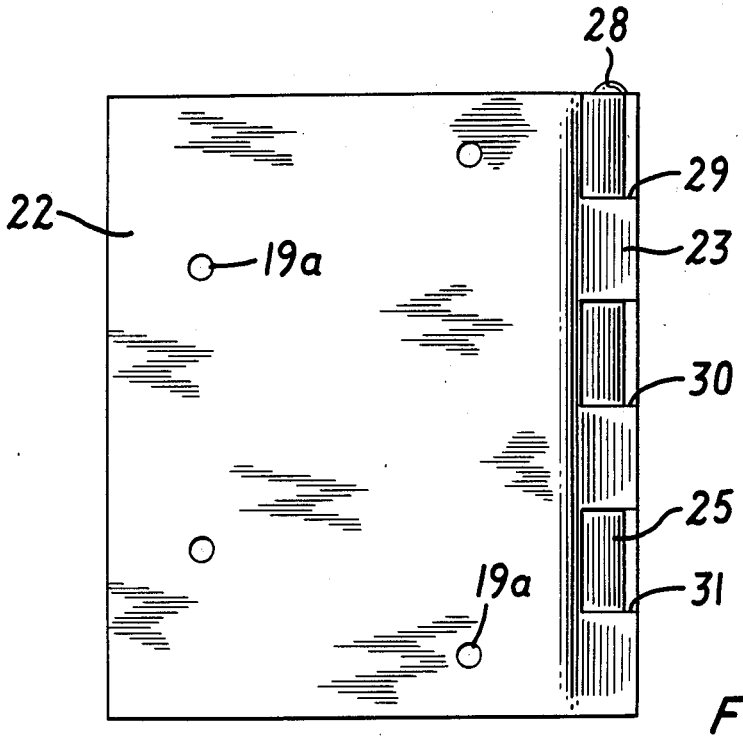
FIG. 5 is a side view of a full mortise hinge formed from a strip similar to that shown in FIG. 1.
Figure 6:
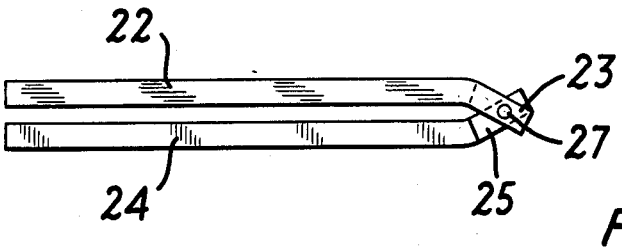
FIG. 6 is an end view of the full mortise hinge shown in FIG. 5.

Referring next to FIGS. 5 and 6, a jamb leaf pad 22 from which extends tabs 23 is hinged to a door leaf 24 carrying tabs 25. Note that the tabs are bent to provide a full mortise type hinge. Holes drilled in the interfitting tabs receive a hinge pin 27 formed with a head 28. Openings **19*a*** in the leaves facilitate mounting of the hinge.

Figure 7:
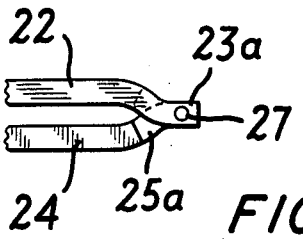
FIG. 7 is an alternate tab configuration for a full mortise hinge.

FIG. 7 illustrates an alternate form of full mortise hinge in which tabs **23*a* and 25*a*** are bent in an elongated S-shape known as a Roman Ogee. This arrangement results in an esthetically pleasing single edge or band when the door is closed. Note also the desirable short projection of the hinge from a closed door in contrast to the much greater projection resulting from a rolled knuckle.

It will be understood that in FIGS. 2, 3, 4, 5, 6 and 7, the angular disposition of the tabs with respect to the leaf pads has been exaggerated in the interests of clarity.

Note that the improved hinge is adaptable, inter alia, to full mortise, full surface, half mortise, and half surface configurations. These hinge types can be provided by having the hinge tabs suitably angularly disposed to the hinge leaf pads.

The criterion generally used in selecting the hinge pin diameter is to insure that the diameter is such that the thickness of the tabs is great enough to provide adequate structural strength in the tabs for the intended use of the hinge. Thus the thickness of the tab wall between the pin and the outer tab surfaces is an important determinant of the ultimate load bearing capacity of the hinge.

Although metal wire is the preferred pin material, the leaves may be made from cold or hot rolled strip or sheet, rolled shapes, roll formed shapes, extruded shapes in metals, die castings, and extruded or molded plastics.

In exemplary hinges made in accordance with the invention, the leaves and tabs are formed from metal strip, for example mild steel, having a thickness of from 0.080 to 0.150 inches. The pin, formed of wire, for example tough steel, has a diameter on the order of 0.040 to 0.090 inches. The small pin diameter, as well as the use of tabs rather than rolled knuckles, effects significant savings in material usage. Yet the inventive hinges are sufficiently strong to function in their intended moderate load environment.

Referring again to FIG. 5, three thrust bearings 29, 30 and 31 formed by the tabs 25 engaging the tabs 23, are provided to support the door leaf 24 on the jamb leaf 22. With the six tabs shown in FIG. 5, five shear planes are provided for the hinge pin 27 at the interfaces of tabs 23 and 25. Even though the hinge pin diameter is only on the order of 0.040 to 0.090 inches, the plurality of shear planes against which the load is distributed provides sufficient strength for the load purposes of the inventive hinge.

To afford sufficient strength and support capacity for moderate loads, there should ordinarily be at least four interfitting tabs on the two hinge leaves to provide at least two thrust bearings and three shear planes for the hinge pin with proper hinge mounting. With lighter loads, the number of tabs may be reduced.

To avoid unwanted handedness of hinges, an unequal number of tabs on the hinge leaves is desirable. Thus, one leaf may include two tabs and the other leaf three tabs.

While the invention has been described with reference to specific embodiments it will be understood that various changes and modification may be made within the scope of the invention which is defined in the appended claims.

I claim:

1. A low cost hinge for moderate loads comprising a pair of leaves, the leaves including mounting pads from which extend spaced interfitting tabs, attachment means for the mounting pads adapted to be used to attach them to a door and jamb, the mounting pads and said tabs having the same uniform thickness throughout the entire extent of the leaves, axially aligned holes in the tabs parallel to the planes of the mounting pads, and a hinge pin extending through the holes in the tabs.

2. A hinge as defined in claim 1, in which at least the tabs of one leaf are angularly disposed to the leaf pad to provide a desired type hinge.

3. A hinge as defined in claim 1, in which the leaf pads and tabs are formed of metal having a thickness of from 0.080 to 0.150 inches and the pin is formed of wire having a diameter on the order of 0.040 to 0.090 inches.

4. A hinge as defined in claim 1, 2 or 3, in which both leaves are similar.

5. A hinge as defined in claim 1, 2 or 3, in which one leaf is formed with one more tab than the other leaf.

6. A hinge as defined in claim 1 or 3, in which the tabs are formed in the shape of a Roman Ogee.

7. A hinge as defined in claim 1, 2 or 3, in which the pin head diameter is about equal to the thickness of the tabs.

8. A hinge as defined in claim 1, 2 or 3 in which the pin is retained in the hinge by tightly fitting into one tab opening.

* * * * *